US006545608B1

(12) United States Patent
Kaufman

(10) Patent No.: US 6,545,608 B1
(45) Date of Patent: Apr. 8, 2003

(54) SMOKING RULES ENFORCEMENT APPARATUS

(76) Inventor: Michael G. Kaufman, 2133 Campus Rd., Beachwood, OH (US) 44122

( * ) Notice: Subject to any disclaimer, the term of this patent is extended or adjusted under 35 U.S.C. 154(b) by 0 days.

(21) Appl. No.: 09/599,818

(22) Filed: Jun. 23, 2000

(51) Int. Cl.[7] ..... G08B 17/12

(52) U.S. Cl. ..... 340/577; 340/578; 340/628; 340/629; 340/630; 250/338.1; 250/336.1; 250/339.01; 250/554

(58) Field of Search ..... 340/577, 578, 340/628, 629, 630; 250/339.05, 338.1, 554, 336.1, 339.01, 339.02, 339.08, 339.15, 340, 372

(56) References Cited

U.S. PATENT DOCUMENTS 6,111,511 A * 8/2000 Sivathanu et al. ..... 340/577

* cited by examiner

*Primary Examiner*—Daryl Pope
(74) *Attorney, Agent, or Firm*—Donald A. Bergquist

(57) ABSTRACT

A flame-sensing element and supporting circuitry is disguised by installing it in an object normally found within the type of room in which it is to monitor. In the best example, a lavatory is monitored by installing a mock fire-safety sprinkler head on the ceiling; the glass-bulb trigger element of a sprinkler head is replaced with a glass bulb flame-sensing element. Alternatively, the glass bulb flame-sensing element and associated electronics may be concealed in a housing designed to house a room deodorant, an air purifier of the ultraviolet or ozone-generating type, a reservoir for a liquid toilet bowl or urinal deodorant, behind the grille of a ventilating air vent, behind the grille of a loudspeaker housing, or within the housing of a smoke detector. The disguise or concealment is meant to hide the apparatus from notice by a surreptitious smoker who would smoke tobacco in an area wherein smoking is prohibited, especially in school lavatories.

22 Claims, 5 Drawing Sheets

SMOKING RULES ENFORCEMENT APPARATUS

BACKGROUND OF THE INVENTION

1. Field of the Invention

This disclosure relates to the detecting of a flame, specifically one ignited for the use of smoking tobacco in areas where smoking is prohibited or illegal. The invention relates specifically to deceiving the smoker into thinking no detection equipment is present to detect his nefarious activity by disguising the detection equipment in the form of an object one would normally expect to see in the surroundings where smoking is prohibited, such as an emergency fire sprinkler head, or concealing the detection equipment within a room deodorant housing, a loudspeaker grille, a ventilation grille, or a smoke detector, as examples.

2. Description of the Prior Art

Smoke detectors have been used in the past to signal the presence of smoke within an enclosed space accessible to the general public, such as any room or more specifically a lavatory. Generally smoke from smoking tobacco is of insufficient quantity to activate a smoke detector designed to sense smoke from a fire that may be damaging to property and personnel. Smoking is illegal in educational institutions; nevertheless, smoking is often covertly practiced, especially in school lavatories and lounges. Smoke detectors are often not sufficiently sensitive to detect smoke from clandestine smoking, especially, where efforts are made to disperse the smoke from the room, as by smoking near an exhaust vent or an open window.

A solution to this problem has been presented in the form of flame detectors; equipment that detects not the smoke from smoking tobacco, but the radiant energy from a flame that is used to ignite the tobacco. Applicant has sold such equipment and has achieved a modicum of success with such a product. A shortcoming of such a product is that its presence and its purpose are quite obvious, so steps may be taken by the aware clandestine smoker to avoid the direct line-of-sight exposure to the detector, in the best-case scenario, or steps may be taken to compromise or incapacitate the equipment.

SUMMARY OF THE INVENTION

Thus it is an object of this invention to provide flame-detecting equipment of a type that is disguised as a normally-expected article in the environment in which it is placed for monitoring smoking, thereby to detect—and to report, even to a remote location for prompt intervention—the prohibited covert smoking activity.

It is an object of this invention to provide an alarm system for surreptitiously detecting and reporting the presence of a flame within the confines of a room, said alarm system comprising: a detection element capable of receiving and reacting to electromagnetic radiation generated by a flame, thereby to generate a first signal; electronic components to process said first signal for activating a second signal that warms of the presence of a flame; and wherein said detection element is within direct view of at least a portion of said room and is incorporated into an object that appears as an object normally present in said room.

It is an object of this invention to disguise electronic flame-detecting equipment as the discharge head of an emergency fire extinguishing or suppression system.

It is an object of this invention to conceal electronic flame-detecting equipment in a housing that appears to be for dispensing room deodorant.

It is an object of this invention to conceal electronic flame-detecting equipment in a housing that appears to be for dispensing toilet bowl deodorant.

It is an object of this invention to conceal electronic flame-detecting equipment in a housing that appears to be a smoke detector.

It is an object of this invention to conceal electronic flame-detecting equipment behind a grille for an air vent.

It is an object of this invention to conceal electronic flame-detecting equipment behind the grille of a loudspeaker housing.

It is an object of this invention to provide electronic flame-detecting equipment in which a triggering signal is communicated on a radio signal to a remote alarm station.

It is an object of this invention to provide electronic flame-detecting equipment in which a triggering signal is communicated via a wire or cable to a remote alarm station.

These and other objects of this invention will be made clear in the following description.

BRIEF DESCRIPTION OF THE DRAWINGS

This invention will be most easily understood by referring to the figures attached hereto, wherein.

DETAILED DESCRIPTION OF THE PREFERRED EMBODIMENTS

The various figures attached hereto are useful in describing this invention. In these figures, the same part is identified throughout by the use of a unique reference number.

Figure 1:
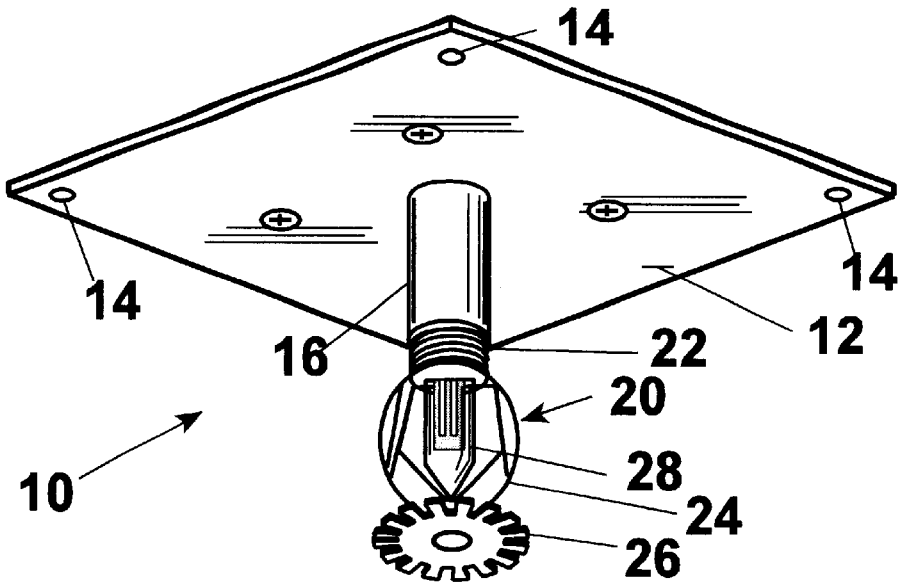
FIG. 1 is a perspective view of a mock fire safety sprinkler head in which a flame detector is concealed.
Figure 2:
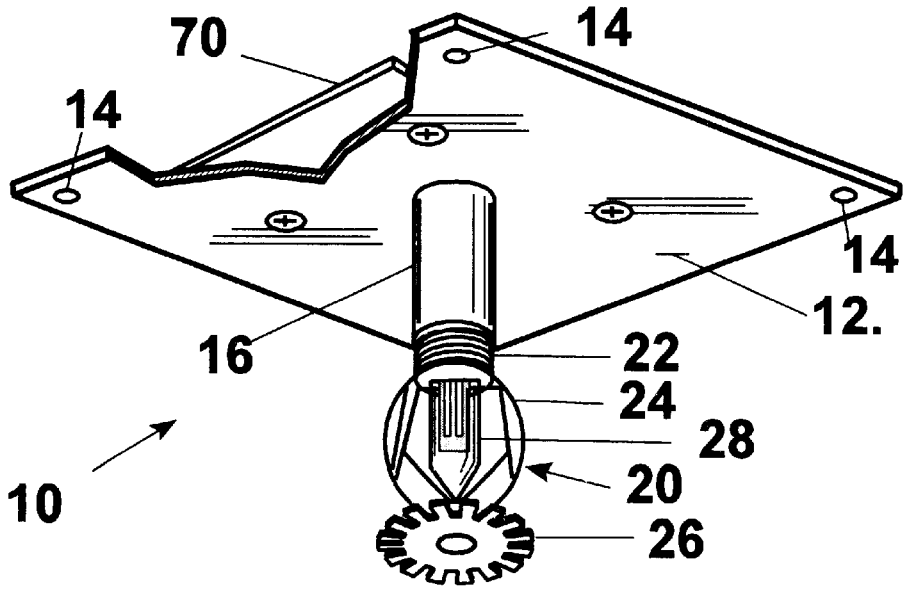
FIG. 2 is a cutaway view of the mock fire safety sprinkler head exposing an electronic circuit board with electronics to support the function of the flame-sensing element.

Beginning first with FIGS. 1 and 2, a mock fire safety sprinkler unit 10 is shown with a flame-sensing element 28 positioned where a real fire safety sprinkler unit would have a similar looking glass bulb trigger element. In truth, the sprinkler head unit 20 is itself real in all respects except for the replacement of the trigger element with the flame-sensing element 28.

The sprinkler head unit 20 is made up of a hollow threaded base 22, a support structure 24, and a disk-like disperser 26. In use in a fire safety system, the sprinkler head unit 20 would be supplied with water through a hollow pipe 16. Such fire safety sprinkler units are most often mounted on or near the ceiling in public buildings and are quite often seen in school buildings and, for our purposes, especially in school lavatories. Thus, for use within the context of this disclosure, such a fire safety sprinkler unit is one of a class of items we define as objects normally present in such a room.

In our use in a mock fire safety sprinkler unit, the modified sprinkler head unit 20 has a flame-sensing element 28 in place of the normal glass bulb trigger element, thereby disguising fly the real purpose of the installed unit. Wires running through the base 22 of the sprinkler head 20 and through the hollow pipe 16 to a circuit board 70 that contains a circuit to support the functions of the flame-sensing element 28 and also contains a transmitter circuit for transmitting a signal to a remote location where an audible/visible alarm may be triggered by such a transmitted signal.

The details of the flame-sensing element, detector circuit, transmitter, receiver, alarm circuit, and audible/visible alarm are not a part of this disclosure as they are already, individually and collectively, in the public domain. They have been sold for more than one year under the name CIGARETTE BUSTER™ WIRELESS SYSTEM by Voice Products Inc., 23715 Mercantile Road, Cleveland, Ohio, 44122, for a use similar to the use of the present invention. The CIGARETTE BUSTER™ WIRELESS SYSTEM has no concealment feature included; each detector unit is clearly labeled with the CIGARETTE BUSTER™ label.

The flame-sensing element used in these devices and in the present invention requires a direct line-of-sight view of a flame for the element to detect the flame and for the electronic circuit that supports the function of the flame-sensing element to generate a triggering signal. The flame-sensing element has a moderate directional character, having the ability to detect ultraviolet light radiation impinging upon it on one side from a spherical sector of nearly 180°. It is somewhat less sensitive to radiation from the opposite side, although it still functions well in that direction over a similar angular range.

Also visible in FIGS. 1 and 2 is a base plate 12 to which hollow pipe 16 is attached for support and which conceals the circuit board 70 from view after the mock fire safety sprinkler unit 10 is installed. The base plate 12 is adapted for mounting on a flat surface, such as a ceiling, by mounting holes 14, as shown. With batteries associated with the circuit board 70, no other electrical nor plumbing connections need be made to complete the installation of the mock fire safety sprinkler unit.

Figure 4:
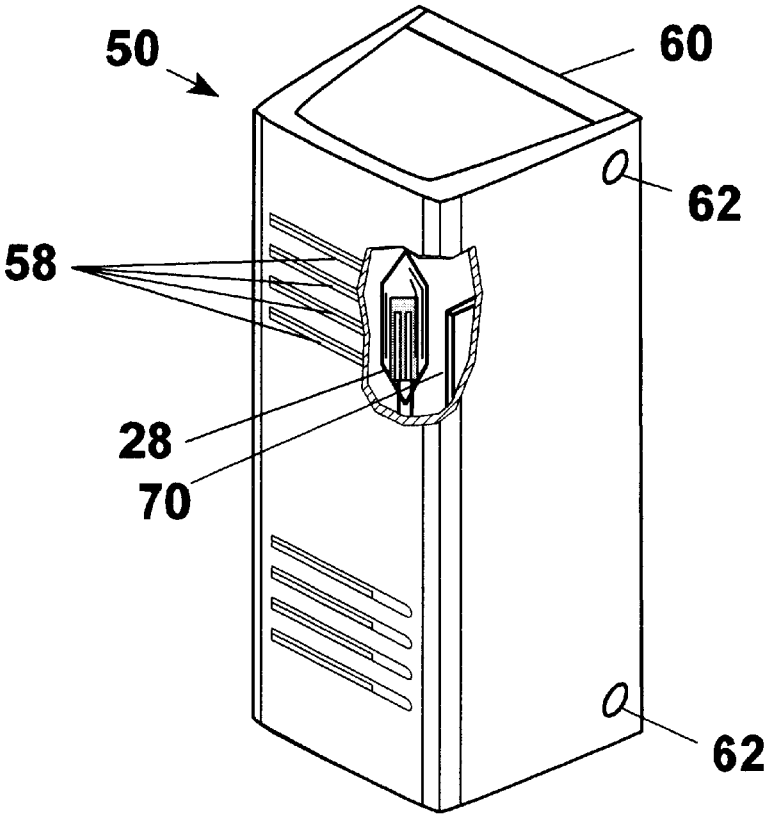
FIG. 4 is a cutaway view of the mock deodorizer housing showing more clearly the flame-sensing element and showing an electronic circuit board with electronics to support the function of the flame-sensing element.
Figure 3:
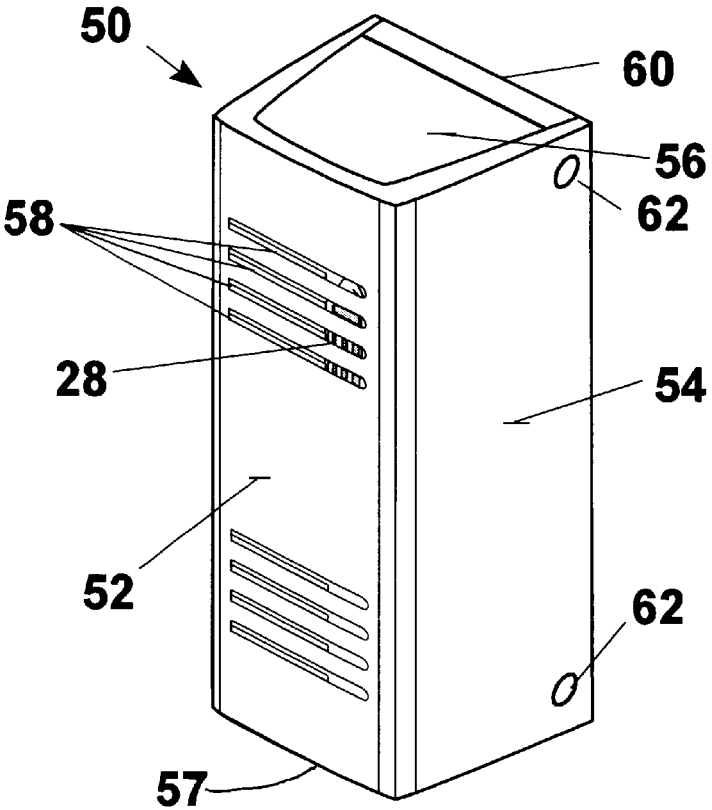
FIG. 3 is a perspective view of a mock deodorizer housing in which a flame detector is concealed.

A second embodiment of the present invention is a mock room deodorizer housing of a type quite often found in lavatories in public buildings and especially in school lavatories. Such a mock room deodorizer housing is illustrated in FIGS. 3 and 4. Such a unit 50 comprises base unit 60 mountable to a wall and supporting by attachment means 62 a cover unit having two side surfaces 54, a front surface 52, a top surface 56, and a bottom surface 57, usually molded as a single piece. At least one of these surfaces has openings 58 for allowing air flow into and out of the housing, a deodorizing material or mechanism normally being held within. In some cases, a similar housing may enclose a sanitizing unit as an ultraviolet lamp or ozone generator. In yet another use, a similar housing may hold a liquid deodorant that wicks down an attached tube into a toilet bowl or a urinal.

In our use, such a housing conceals the detector circuit and transmitter on circuit board 70 and the openings 58 provide sufficient openings to permit light from a flame to pass through to reach a flame-sensing element 28 mounted directly behind them.

Whereas such deodorizer housings, sanitizing unit housings, and liquid deodorant housings are often mounted on walls in public buildings and are quite often seen in school buildings and, for our purposes, especially in school lavatories. Thus, for use within the context of this disclosure, such a housing is one of a class of items we define as objects normally present in such a room.

Figure 5:
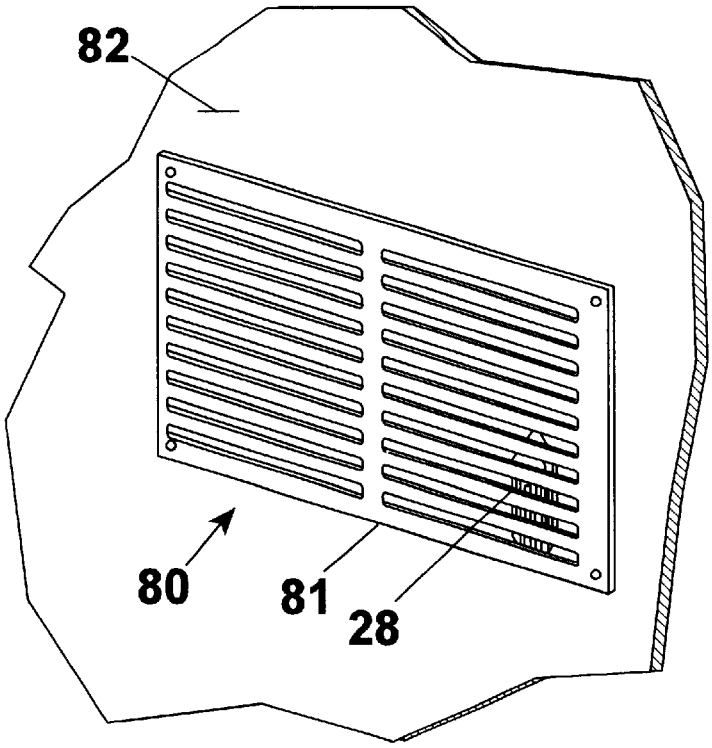
FIG. 5 is a perspective view of an air ventilation grille behind which a flame detector is concealed.

In FIG. 5, one can see the flame-sensing element 28 mounted directly behind a grille assembly 80 for an air vent that forms a part of a normal air ventilating system, passing through a wall 82. The grille 81 could also be a mock grille, installed to appear to be a part of a ventilating system, but provided solely for the disguising of a flame detector as taught herein.

Whereas such ventilation grilles are often mounted on walls or ceilings in public buildings and are quite often seen in school buildings and, for our purposes, especially in school lavatories. Thus, for use within the context of this disclosure, such a grille is one of a class of items we define as objects normally present in such a room.

Figure 6:
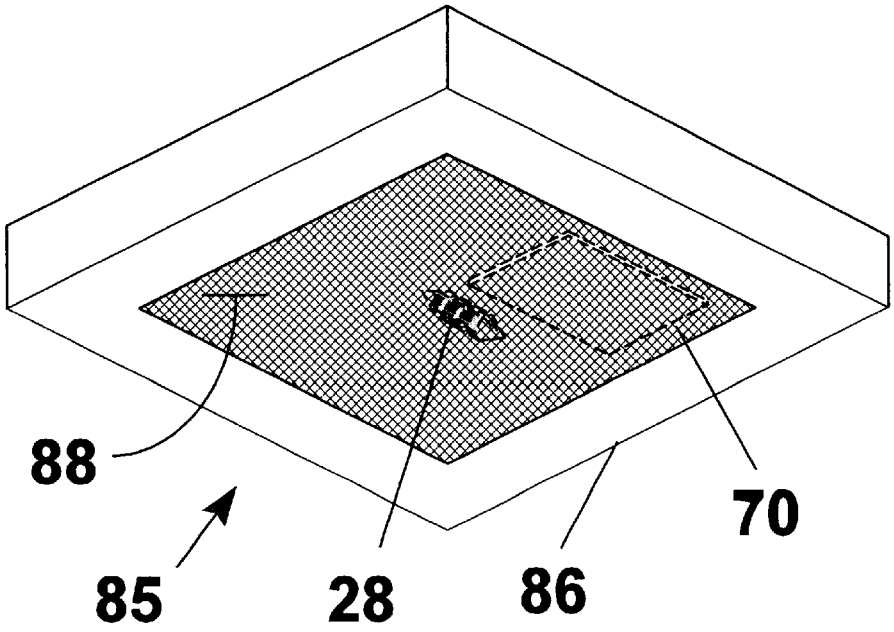
FIG. 6 is a perspective view of a housing for a loudspeaker in which a flame detector is concealed behind the grille thereof.

In many public buildings and especially in school buildings, including lavatories therein, loudspeakers are installed for making public announcements or issuing instructions such as evacuation instructions or other warnings. FIG. 6 is a perspective view of a housing for a loudspeaker 85 in which a flame detector is concealed. The detector element 28 and the circuit board 70 holding circuitry to support the function thereof are mounted behind the grill 88 mounted in the housing 86. The grille 88 is most often made of an open-weave fabric that allows, the detector element to be sufficiently exposed to light or radiation from the environment of the room. The loudspeaker housing could be a sham or it could house a functioning loudspeaker.

Whereas such loudspeaker housings are often mounted on walls or ceilings in public buildings and are quite often seen in school buildings and, for our purposes, especially in school lavatories. Thus, for use within the context of this disclosure, such a loudspeaker housing is one of a class of items we define as objects normally present in such a room.

Figure 7:
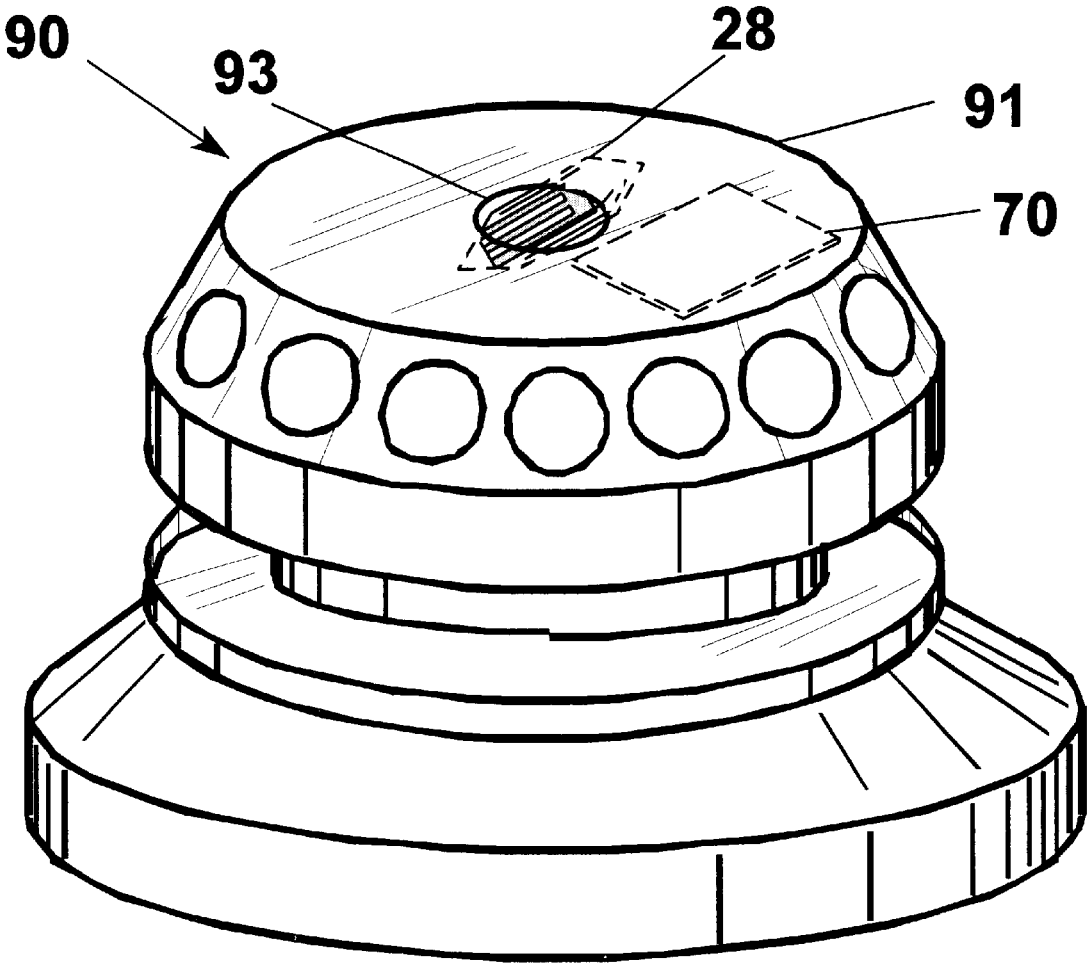
FIG. 7 is a perspective view of a housing for a smoke detector in which a flame detector is concealed.

Yet another object often present in public rooms and especially lavatories and more particularly in school lavatories is a smoke detector. FIG. 7 is a perspective view of a housing for a smoke detector 90 in which a flame detector, as evidenced by detector element 28 and the circuit board 70 holding circuitry to support the function thereof are concealed within the housing 91. A clandestine smoker may well imagine (often rightly so) that the smoke detector is not sufficiently sensitive to detect his nefarious activity. He may stand close to an open window or ventilation system to disperse the smoke generated by his activity. The housing could house a real smoke detector or it could be a sham.

Whereas such smoke detector housings are often mounted on walls or ceilings in public buildings and are quite often seen in school buildings and, for our purposes, especially in school lavatories. Thus, for use within the context of this disclosure, such a smoke detector housing is one of a class of items we define as objects normally present in such a room.

Figure 8:
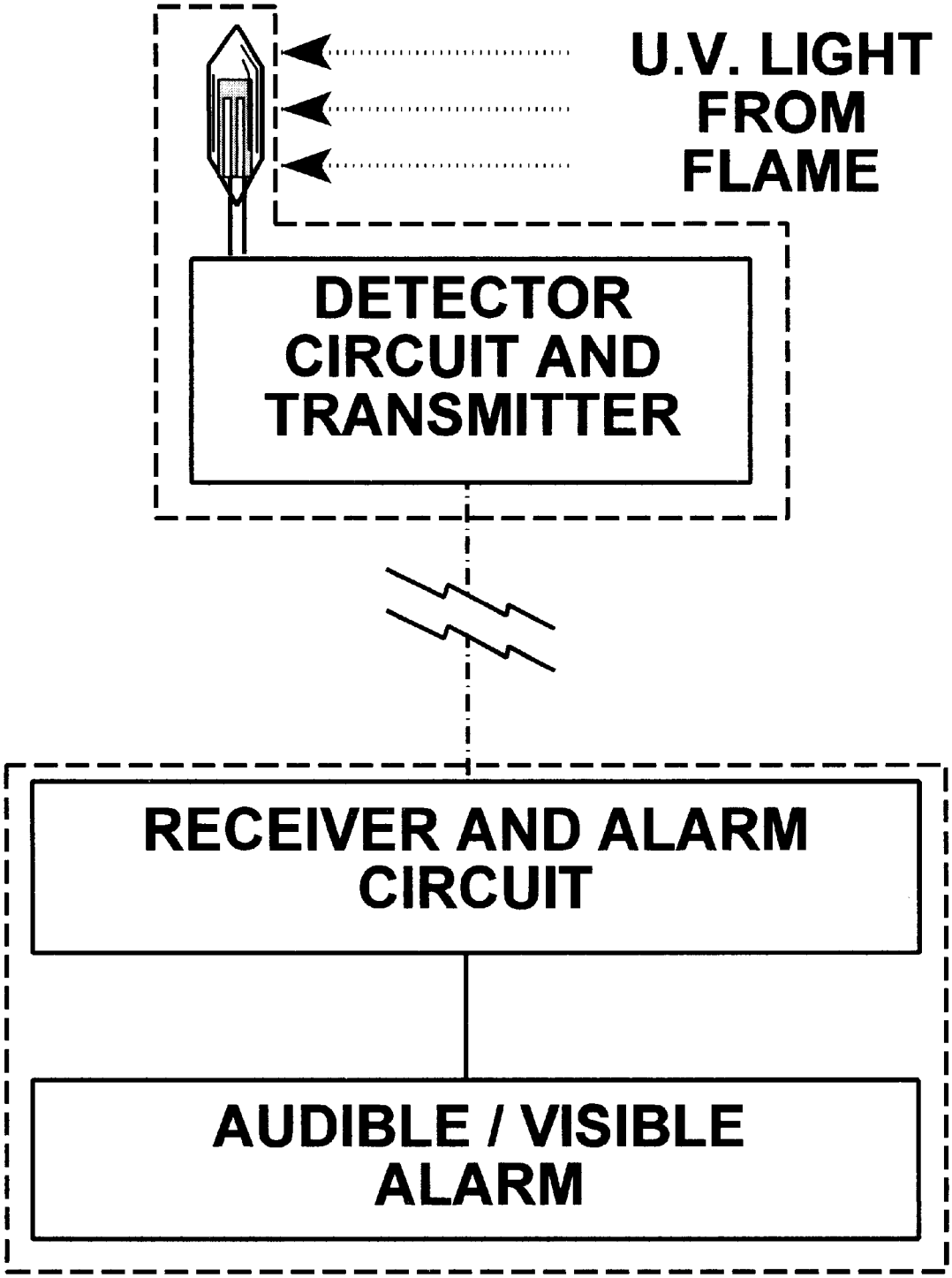
FIG. 8 is a block diagram illustrating the elements of the best mode of the invention.

To better describe the operation of a system employing the present invention in its best mode, FIG. 8 shows the apparatus of this invention as being in two separate locations. The flame-sensing element and its associated detector circuit and transmitter are located in one unit at a first location and the receiver and alarm circuit and the audible/visible alarm are located in a second unit at a second location. When light of specific wavelengths (in the ultra-violet range) generated by a flame impinges upon the flame-sensing element, a first signal is generated in the detector circuit and is transmitted to the receiver and alarm circuit, which generates a second signal comprising an audible or visible alarm. The transmission from the first unit to the second unit is preferably a low-power radio signal. Optionally, a hard-wired link can be installed between the first unit and the second unit.

This invention is not limited to a single surreptitiously-mounted flame detector. Indeed, a plurality of detector units can be employed, each sending, when triggered, its unique signal to the receiver and alarm circuit to trigger an audible or visible alarm unique to the specific detector. Such a system can thus be used, for instance, in a school environment to monitor a plurality of rooms, with the alarm unit capable of identifying the specific location of the detected flame to provide rapid personal response to the room where the flame has been detected. The ability to provide a swift deterrent in the form of personal intervention to smoking in areas designated as no-smoking areas is the result.

The invention is meant to be interpreted as broadly as possible as described, but is limited to the claims hereto attached.

I claim:

1. An alarm system for surreptitiously detecting and reporting the presence of a flame within the confines of a room, said alarm system comprising:

a detection element capable of receiving and reacting to electromagnetic radiation generated by a flame such as may be used to ignite materials for smoking, thereby to generate a first signal;

electronic components to process said first signal for activating a second signal that warns of the presence of a flame; and wherein the distinguishing feature is that said detection element is within direct view of at least a portion of said room and is incorporated into an object that appears as an object normally present in said room, thereby to deceive a clandestine smoker into thinking no effective smoking-deterrent equipment is present to detect his activity.

2. The alarm system of claim 1 wherein said object normally present in said room is a sprinkler head for an emergency fire sprinkler system.

3. The alarm system of claim 2 wherein said detection element replaces a glass bulb that would serve as a trigger mechanism for an emergency fire sprinkler head.

4. The alarm system of claim 1 wherein said electronic components comprise a first electronic component directly connected with said detection element and also comprises a second electronic component remote from said first electronic component and capable of receiving a triggering signal communicated from said first electronic component to activate said second signal that warns of the presence of a flame.

5. The alarm system of claim 4 wherein said triggering signal is communicated on a radio signal.

6. The alarm system of claim 4 wherein said triggering signal is communicated over a hard-wired connection.

7. The alarm system of claim 1 wherein said object normally present in said room is a housing for a room deodorizer.

8. The alarm system of claim 1 wherein said object normally present in said room is a housing for a smoke detector.

9. The alarm system of claim 1 wherein said object normally present in said room is a housing for a loudspeaker.

10. The alarm system of claim 1 wherein said object normally present in said room is a grille for a ventilation system.

11. The alarm system of claim 1 wherein said object normally present in said room is a grille for a mock ventilation system.

12. An alarm system for surreptitiously detecting and reporting the presence of a flame within the confines of a room, said alarm system comprising:

a detection element capable of receiving and reacting to electromagnetic radiation generated by a flame such as may be used to ignite materials for smoking, thereby to generate a first signal;

electronic components to process said first signal for activating a second signal that warns of the presence of a flame; and wherein the distinguishing features are that said detection element reacts to said electromagnetic radiation in the ultra-violet range, is within direct view of at least a portion of said room and is incorporated into an object that appears as an object normally present in said room, thereby to deceive a clandestine smoker into thinking no effective smoking-deterrent equipment is present to detect his activity.

13. The alarm system of claim 12 wherein said object normally present in said room is a sprinkler head for an emergency fire sprinkler system.

14. The alarm system of claim 13 wherein said detection element replaces a glass bulb that would serve as a trigger mechanism for an emergency fire sprinkler head.

15. The alarm system of claim 12 wherein said electronic components comprise a first electronic component directly connected with said detection element and also comprises a second electronic component remote from said first electronic component and capable of receiving a triggering signal communicated from said first electronic component to activate said second signal that warns of the presence of a flame.

16. The alarm system of claim 15 wherein said triggering signal is communicated on a radio signal.

17. The alarm system of claim 15 wherein said triggering signal is communicated over a hard-wired connection.

18. The alarm system of claim 12 wherein said object normally present in said room is a housing for a room deodorizer.

19. The alarm system of claim 12 wherein said object normally present in said room is a housing for a smoke detector.

20. The alarm system of claim 12 wherein said object normally present in said room is a housing for a loudspeaker.

21. The alarm system of claim 12 wherein said object normally present in said room is a grille for a ventilation system.

22. The alarm system of claim 12 wherein said object normally present in said room is a grille for a mock ventilation system.

* * * * *